United States Patent [19]

Tanaka et al.

[11] 4,239,845

[45] Dec. 16, 1980

[54] ELECTROPHOTOGRAPHIC COPYING METHOD USING TWO TONERS ON MAGNETIC BRUSH

[75] Inventors: Susumu Tanaka, Sakai; Koji Nagai; Sanzi Inagaki, both of Itami, all of Japan

[73] Assignee: Minolta Camera Kabushiki Kaisha, Osaka, Japan

[21] Appl. No.: 16,609

[22] Filed: Mar. 1, 1979

[30] Foreign Application Priority Data

Mar. 9, 1978 [JP] Japan ..... 53/27246

[51] Int. Cl.[3] ..... G03G 13/09; G03G 13/22; G03G 9/14

[52] U.S. Cl. ..... 430/122; 430/124; 430/125; 430/126; 430/107; 430/109

[58] Field of Search ..... 96/15 D, 1.4; 427/18, 427/24; 430/122, 124, 126

[56] References Cited

U.S. PATENT DOCUMENTS

| | | | |
|---|---|---|---|
| 3,262,806 | 7/1966 | Gourge | 427/18 |
| 3,816,115 | 6/1974 | Gundlach et al. | 96/1.4 |
| 3,926,824 | 12/1975 | Lipani | 96/1.4 X |
| 4,108,786 | 8/1978 | Takayama et al. | 96/15 D X |
| 4,142,981 | 3/1979 | Bean et al. | 252/62.1 P |
| 4,165,393 | 8/1979 | Suzuki et al. | |

*Primary Examiner*—Roland E. Martin, Jr.
*Attorney, Agent, or Firm*—Wenderoth, Lind & Ponack

[57] ABSTRACT

An electrophotographic copying method is carried out by the use of a developing material consisting of a magnetic toner of a volume resistivity within the range of $10^{10}$ to $10^{14}$ Ω·cm and a non-magnetic and electrically insulating toner. During the development of an electrostatic latent image on a photoconductive support member into a toner image by means of a magnetic brush developing process, particles of both of the magnetic and non-magnetic toners are caused to deposit on an image area of the electrostatic latent image and particles of only the magnetic toner are caused to deposit on a non-image area of the electrostatic latent image. The toner image so developed is subsequently transferred from the photoconductive support member to a sheet of final support material and then fixed.

5 Claims, 4 Drawing Figures

ELECTROPHOTOGRAPHIC COPYING METHOD USING TWO TONERS ON MAGNETIC BRUSH

BACKGROUND OF THE INVENTION

The present invention generally relates to an electrophotographic copying method and, more particularly, to a dry electrophotographic copying method for electrically transferring a powder image from an intermediate photoconductive support surface onto a sheet of final support material.

In practicing an electrophotographic copying method of the system referred to above, a two-component developing material has heretofore been employed for developing an electrostatic latent image on the intermediate photoconductive support surface in the form of an electrical potential pattern to produce the powder image corresponding to a pattern of light and shadow to be reproduced. The two-component developing material is comprised of a mixture of toner particles, such as particles of a synthetic resin coloring agent, with carrier beads such as powdery iron or glass beads. When in use, the toner and the carrier are stirred to allow the toner particles to be triboelectrically charged to a polarity opposite to that of the electric potential pattern on the photoconductive support surface, and then applied onto the photoconductive support surface to develop the electrostatic latent image into the toner image.

In the mixture of carrier and toner heretofore used for the development of the electrostatic latent image, the carrier is the component which is not consumed and is recovered for reuse whereas the toner is consumed. Accordingly, for the purpose of achievement of the reproduction of a reasonably acceptable image on the sheet of final support material such as a copying paper, the toner must from time to time be replenished into a developer tank to maintain the proper ratio in the mixture of the toner to the carrier throughout cycles of copying operation. Therefore, the practice of the conventional electrophotographic copying method using the toner-carrier mixture requires the employment of a complicated toner replenishing device. In addition, the replacement of the carrier with a fresh mass of similar carrier particles at regular intervals is also required since the carrier particles tend to be deteriorated, as they are used for a prolonged period of time, to such an extent that the quality of the reproduced image will adversely affected.

Another electrophotographic copying method using a one-component developing material is also well known to those skilled in the art. This one-component developing material is generally employed in the form of a mass of magnetic toner particles each being constituted by a synthetic resin block containing magnetic particles, uniformly dispersed therein, and coated with an electroconductive material such as carbon black. The development of the electrostatic latent image into the toner image according to this method is performed by way of a magnetic brush development technique as is the case with the toner image development using the two-component developing material. Whereas in the toner image development using the two-component developing material, the electrostatic attractive force acting between the toner, which has acquired an electrical charge as a result of frictional electricity, and the electrical charge of the latent image on the photoconductive support surface plays a major role in transferring toner particles onto the photoconductive support surface to form the toner image thereon, a similar transfer in the toner image development using the one-component developing material takes place by the combined effect of a force of electrostatic attraction, exerted between the electric charge of the latent image on the photoconductive support surface and the charge which has been injected, in a polarity opposite to that of the latent image on the photoconductive support surface, through an electroconductive sleeve or shell into the magnetic toner particles as the latter had approached the latent image on the photoconductive support surface, the value of the electric charge so injected corresponding to that of the latent image, and a force of magnetic attraction exerted by a magnet positioned internally of the sleeve or shell for magnetically retaining the magnetic toner particles on the sheeve or shell.

The toner image development using the one-component developing material substantially eliminates such disadvantages inherent in the toner image development using the two-component developing material as resulting from the inclusion of the carrier which forms the unconsumable part of the two-component developing material, but has some disadvantages, for example, the lack of a high fidelity reproduction in gradation, the difficulty in fixing and the inability of use with an ordinary plain copying paper because of the difficulty involved in transferring the toner image from the photoconductive support surface of such plain copying paper by the use of a corona discharge technique. These disadvantages are considered as originating from the fact that the one-component developing material, i.e., the magnetic toner, is required to have a relatively low resistance to facilitate the charge injection from the photoconductive support surface to the magnetic toner through the sleeve or shell during the application of magnetic toner particles onto the electrostatic latent image on the photoconductive support surface. Because of the required use of the one-component developing material of relatively low electric resistance, the toner image development using the one-component developing material is likely to involve the instability of transfer of the toner image from the photoconductive support surface to the sheet of final support material which would result in the insufficient transfer of the toner image onto the sheet of final support material to every detail and/or adherence of magnetic toner particles to non-image areas, i.e., background deposition of the magnetic toner particles. The consequence is that the image reproduced on the sheet of final support material after the toner image transferred onto the sheet of final support material has been fixed will be blurred and/or foggy.

A developing material which substantially eliminates the above described disadvantages and inconveniences inherent in any of the two-component developing material and the one-component developing material is disclosed in, for example, the Japanese Laid-open Patent Publication No. 52-65443, laid open to public inspection on May 30, 1970, and the copending U.S. patent application Ser. No. 863,616, filed on Dec. 23, 1977 and assigned to the same assignee of the present invention.

The process disclosed in the above mentioned publication is a magnetic brush development method wherein the developing material is magnetically attracted onto the sleeve or shell by the action of a magnet, housed inside the sleeve or shell, to form a magnetic brush which subsequently contacts the electrostatic latent image on the photoconductive support surface to develop such latent image into the powder image. The developing material used in this magnetic brush development process and disclosed in the above mentioned publication is comprised of a mixture of a toner of low volume resistivity, for example, $10^5$ Ω·cm, and a toner of high volume resistivity, and at least one of the both toners is a magnetic toner. The toner image development using the mixture of these toners of low and high volume resistivities is carried out by triboelectrically charging both in opposite polarities to each other during the supplying of the toner mixture from a hopper onto the sleeve or shell and/or during the transport of the toner mixture through and by means of the sleeve or shell towards the photoconductive support surface and, then, causing the toner mixture to be attracted onto the electrostatic latent image on the photoconductive support surface. In this process, for transporting particles of the toner mixture from the hopper towards the photoconductive support surface, the electrostatic force of attraction exerted between the toner of low volume resistivity and that of high volume resistivity must be higher than the magnetic force of attraction exerted by the magnet housed inside the sleeve or shell, or otherwise the electrostatic force of attraction necessary to bind the toners of low and high volume resistivities together may be overcome by the magnetic force of attraction of the magnet, resulting in separation of the toners of low and high volume resistivities from each other, the consequence of which is that both the toner of low volume resistivity and that of high volume resistivity will not uniformly be applied onto the electrostatic latent image on the photoconductive support surface.

On the other hand, the developing material disclosed in the above mentioned copending application is comprised of a mixture of a magnetic toner of a volume resistivity within the range of $10^5$ to $10^{14}$ Ω·cm and a non-magnetic and electrically insulating toner and is used in the electrophotographic copying method using the magnetic brush development technique. During the development of the toner image, the non-magnetic and electrically insulating toner particles are attracted onto the electric charge pattern on the photoconductive support surface by the effect of the electric charge opposite in polarity to that of the pattern on the photoconductive support surface, which has been charged as a result of frictional electricity, whereas the magnetic toner particles behave in a manner similar to the one-component developing material. Furthermore, during the transfer of the toner image from the photoconductive support surface to the sheet of final support material, both the non-magnetic and electrically insulating toner and the magnetic toner are transferred by the effect of an electrical mirror image force and van der Waal's forces.

The developing material of the composition disclosed in any one of the above mentioned publication and copending application is, because of the absence of unconsumable carrier, free from such problems, e.g., deterioration of carrier beads and replenishment of the toner particles, as involved in the two-component developing material, i.e., the toner-carrier mixture, and is, unlike the one-component developing material of the composition hereinbefore described, useable in transferring the toner image from the photoconductive support surface to a sheet of final support material by the effect of a corona discharge that charges the sheet of final support material.

However, while conducting a series of experiments using a the developing material of the composition disclosed and claimed in the above mentioned copending application, the present inventors have found that the developing material itself, or the practical use of thereof, involves the following problems left unsolved.

(1) When the magnetic toner of a relatively low range of volume resistivity, 30μ in average particle size, was mixed with the non-magnetic and insulating toner of 15μ in average particle size in a proportion of 9:1 and the resultant mixture was used in developing the toner image on the photoconductive support surface while the bias voltage and the magnetic attractive force of the magnet were so adjusted that no background deposition could occur, the resultant image reproduced on the sheet of final support material showed an acceptable contrast between the toner deposition and the background, but an insufficient resolution. On the other hand, when the magnetic toner of a relatively high range of volume resistivity, 30μ in average particle size, was mixed with the non-magnetic and insulating toner of 15μ in average particle size in a proportion of 9:1 and the resultant mixture was used in developing the toner image on the photoconductive support surface while the bias voltage and the magnetic attractive force of the magnet were so adjusted that no background deposition occurred, the resultant image reproduced on the sheet of final support material showed the reverse effect, that is, an acceptable resolution, but a low contrast.

In this way, the use of the developing material of the composition disclosed and claimed in the above mentioned copending application does not result in the high fidelity reproduction of the image of both high resolution and high contrast.

(2) The electrophotographically reproduced image of pale characters and/or fine lines often showed the reduced line width with reduced contrast.

(3) When the magnetic brush development was effected during the electrophotographic reproduction of, for example, an area image or a consecutive image while the magnet housed inside the sheeve or shell was rotated at a rate of 1,000 rpm as reduced from 2,000 rpm for the purpose of avoiding the possible heating under the influence of an eddy current, the reproduced image on the sheet of final support material was such that the contrast between the toner deposition and the background was gradually reduced from the front of the image towards the rear of the same, thereby lacking a high fidelity reproduction capability.

These problems must be solved by all means to enable the developing material to be commercial.

SUMMARY OF THE INVENTION

Accordingly, the present invention has been developed in the course of various attempts to solve the above mentioned problems and has as its essential object to provide an improved electrophotographic copying method capable of giving a reproduced image of high resolution.

To this end, the electrophotographic reproduction is, according to the present invention, carried out by forming an electrostatic latent image on a photoconductive support member, then applying a developing material onto the photoconductive support member by means of a magnetic brush developing technique known per se, causing the toner image so developed on the photoconductive support member to be transferred onto a sheet of final support material by the effect of a corona discharge, and causing the toner image so transferred onto the sheet of final support material to be fixed thereon.

The developing material used in the practice of the present invention is a mixture of a non-magnetic and electrically insulative toner with a magnetic toner of a volume resistivity within the range of $10^{10}$ to $10^{13}$ Ω·cm, preferably within the range of $10^{12}$ to $10^{13}$ Ω·cm. The application of the developing material of the above described composition onto the photoconductive support member to develop the toner image by means of the magnetic brush developing technique is carried out by applying a bias voltage such that particles of both of the magnetic toner and the non-magnetic and electrically insulative toner are forced to adhere to an image area of the electrostatic latent image on the photoconductive support member while a certain amount of particles of the magnetic toner are forced to adhere to a non-image area, that is, a background, of the electrostatic latent image.

In the prior art electrophotographic copying method, the bias voltage, the same in polarity as and of a value higher than the electric potential of the non-image area of the electrostatic latent image on the photoconductive support member, is applied to cause the electric potential of the non-image area to have the same polarity as that of triboelectrically charged particles of the non-magnetic toner, i.e., to be reversed in polarity to that of the electrostatic latent image on the photoconductive support member, so that no non-magnetic toner is caused to adhere to the non-image area of the electrostatic latent image, thereby avoiding a foggy image reproduction which may otherwise result from the deposition of the non-magnetic toner to the non-image area of the electrostatic latent image.

On the other hand, with the developing material disclosed in the above mentioned copending application since the magnetic toner is caused to be charged in a polarity the same as that of the electrostatic latent image, there is the possibility that, when the potential of the non-image area is reversed by the application of the bias voltage, the magnetic toner particles are held to the photoconductive support member, tending to constitute a cause for the foggy image reproduction. This possibility is, according to the method disclosed in the above mentioned copending application, eliminated by adjusting, for example, increasing, the magnetic attractive force of the magnet housed inside the sleeve or shell and the distance between the sleeve or shell and the photoconductive support member, thereby avoiding the deposition of the magnetic toner particles which may occur simultaneously with the application of the bias voltage.

On the contrary thereto, according to the method of the present invention, the bias voltage, the same in polarity as and of a value higher than the electric potential of the non-image area is applied to avoid the deposition of particles of the non-magnetic toner on the non-image area on one hand and, on the other hand, particles of the magnetic toner are allowed to deposit on the non-image area in contrast to the prior art teachings.

More specifically, the present invention is directed to an electrophotographic copying method which comprises the steps of:

a. forming an electrostatic latent image on a photoconductive support member, said electrostatic latent image being comprised of an image area and a non-image area;

b. developing the electrostatic latent image to a toner image with a developing material consisting of a particulate, magnetic toner having a volume resistivity of about $10^{10}$ to $10^{13}$ Ω·cm and a particulate, non-magnetic, electrically insulating toner;

said magnetic toner being present in an amount of 85 to 98% and said non-magnetic toner being present in an amount of 2 to 15%, said percentages being based on the total weight of the developing material;

said development being effected by the magnetic brush method and comprising;

(i) triboelectrically charging said magnetic and non-magnetic toners, the polarity of said non-magnetic toner being opposite that of said electrostatic latent image and the polarity of said magnetic toner being the same as that of said electrostatic latent image, (ii) magnetically attracting said developing material to the surface of a sleeve having a magnet housed therein to form a magnetic brush thereon and (iii) contacting said electrostatic latent image with said magnetic brush whereby particles of both magnetic and non-magnetic toner are deposited on and adhere to said image area and particles of said magnetic toner are deposited on and adhere to said non-image area;

and during said development applying a bias voltage of the same polarity but of a higher value than the potential of the non-image area of said latent image, to avoid deposition of particles of non-magnetic particles on said non-image area and to permit the magnetic toner to overcome the magnetic force exerted thereon by said magnet in said sleeve;

b. transferring the particles of both of the magnetic and non-magnetic toners, which have been deposited on the image area of the electrostatic latent image, from the photoconductive support member to a sheet of final support material by means of a corona charge technique; and c. fixing the toner image so transferred to the sheet of final support material.

These and other objects and features of the present invention will become apparent from the following description taken by way of example for the purpose of illustration of the present invention with reference to the accompanying drawings, in which.

DETAILED DESCRIPTION OF THE INVENTION

Figure 2:
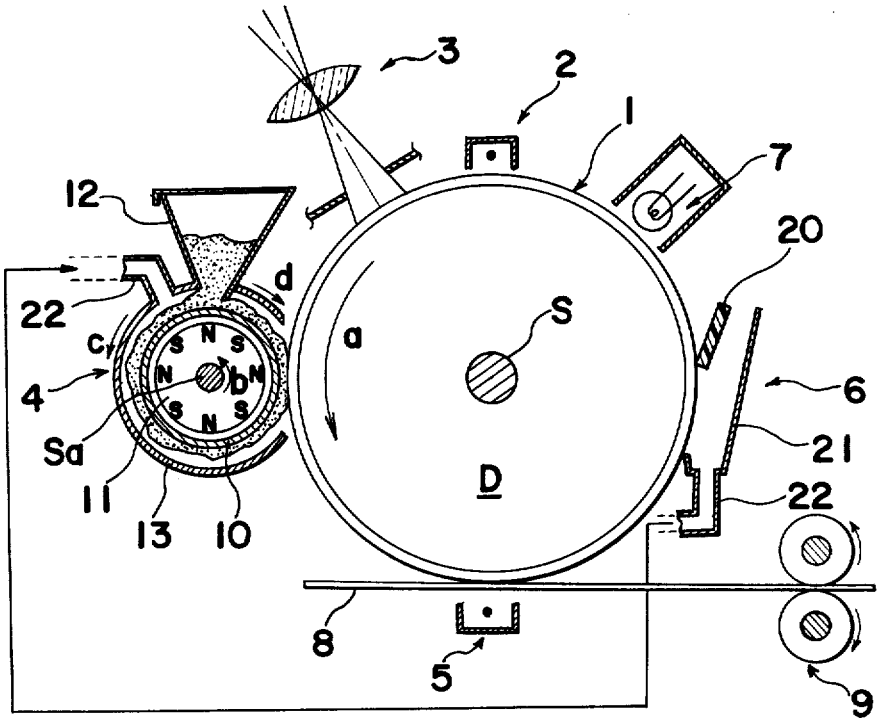
FIG. 2 is a schematic side elevational view of a copying machine used to practise the method of the present invention.

Referring first to FIG. 2, a photoconductive support member 1 is in the form of a layer of a mixture of CdS and $CdCO_3$ as is well known to those skilled in the art and is supported on the outer peripheral surface of a drum D which is mounted on a shaft S for rotation in one direction together with the shaft S. As is well known to those skilled in the art, the photoconductive drum D is rotated past a plurality of processing stations including a charging station at which a corona charger 2 is located, an exposing station at which an optical projector system 3 is located, a developing station at which a developer unit 4, a transfer station at which a transfer corona charger 5 is located, a cleaning station at which a cleaning unit 6 is located, and an erasing station at which an erasing lamp 7 is located.

More specifically, during one complete rotation of the photoconductive drum D, the following processes take place successively. The photoconductive support member 1 is first charged by the corona charger 2 which applies an electric potential across it. The charged photoconductive support member 1 is then exposed imagewise to light projected by means of the optical projector system 3 so that an electrostatic latent image can be formed on a local surface area of the photoconductive support member 1 in a pattern corresponding to the pattern of an image to be reproduced. The electrostatic latent image is then developed into a toner image by exposing the surface of the photoconductive support member 1 to a developing material supplied from the developer unit 4 in a manner as will be described later. The toner image can then be transferred from the photoconductive support member to a sheet of final support material, for example, a copying paper 8, which has been supplied from a paper supply unit (not shown) by means of a feed roll assembly in controlled synchronism with the rotation of the drum D. The transfer of the toner image from the photoconductive support member 1 to the copying paper 8 is carried out by electrically charging the copying paper 8 by means of the transfer corona charger 5 and placing the copying paper in contact with the photoconductive support member 1. After the transfer of the toner image to the copying paper 8, the photoconductive support member 1 is cleaned by the cleaning unit 6, in a manner as will be described later, and the residue electric potential charged on the photoconductive support member 1 is then erased by exposing it to light from the erasing lamp 7. On the other hand, the copying paper 8 bearing the toner image transferred thereto at the transfer station is passed through a fixing unit 9 where the toner particles on the copying paper 8 are fused by heat, and the copy is finally ejected out of the copying machine.

The developer unit 4 comprises an electroconductive sleeve 10 fixedly supported in position within a machine housing (not shown) in parallel relation to the shaft S, a cylindrical magnet unit 11 rigidly mounted on a shaft Sa within and coaxial to the sleeve 10 for rotation together with said shaft Sa, a hopper 12 positioned above the sleeve 10 for accommodating and supplying a developing material onto the outer periphery of the sleeve 10, and a casing 13 enclosing the sleeve 10 therein. This developer unit 4 is so designed that the minimum distance between the outer periphery of the photoconductive support member 1 on the drum D and that of the sleeve 10 is 0.7 mm. and the magnet unit 11 is of a type capable of exerting a magnetic force of 750 gauss as measured at the outer peripheral surface of the sleeve 10 and is rotated at 2,000 r.p.m.

The cleaning unit 6 comprises a blade 20 having one side edge held in sliding contact with the photoconductive support member 1 during the rotation of the drum D for removing the residue of the developing material from the photoconductive support member 1. The developing material so removed at the cleaning station is collected in a recovery receptacle 21 and circulated back into the developer unit 4 by means of a recovery duct 22 communicated to the recovery receptacle 21.

When the electrophotographic copying machine of the construction described above is in operation, the entire surface of the photoconductive support member 1 is first electrically charged to −550 volt at the charging station and then exposed imagewise to light of 8 lux·sec projected at the exposing station with an electrostatic latent image consequently formed on the photoconductive support member 1. The electric potential on the photoconductive support member 1 decays in the surface area of a minimum possible potential of −150 volt which is struck by light while the dark area of the projected image retains its electrostatic charge. The electrostatic latent image is then developed by exposing the photoconductive support member 1 to particles of the developing material dispensed by the developer unit 4 while a bias voltage of the same polarity as that of the electrostatic latent image is applied to the sleeve 10. A toner image is thus formed on the photoconductive support member 1 and this toner image is subsequently transferred from the photoconductive support member 1 onto a sheet 8 of final support material which may be an ordinary plain copying paper.

The copying paper 8 bearing the toner image so transferred from the photoconductive support member 1 at the transfer station is transported to the fixing unit 9 where the particles forming the toner image on the copying paper 8 are fused to fix on the paper 8. On the other hand, some of the particles of the developing material remaining on the photoconductive support member 1 without being transferred onto the copying paper 8 are then removed by the blade 20 at the cleaning station into the recovery receptacle 21, the developing material in the recovery receptacle 21 being circulated back to the developer unit 4 through the recovery duct 22. After the cleaning, the residue electrical potential remaining on the photoconductive support member 1 is erased by exposing the photoconductive support member 1 to light emitted from the eraser lamp 7.

The present invention will be further described by reference to the following specific examples which are intended to illustrate the various preferred embodiments of the present invention.

For the purpose of carrying out the development process, the following types of developing material were prepared. It is to be noted that parts and ratios employed in the following description are by weight unless otherwise indicated.

Toner Mix I

Magnetic Toner:

100 parts of styrene-acrylic resin (identified by a tradename "HYMER-SMB73" manufactured by Sanyo Chemical Industries, Ltd., of Japan), 100 parts of finely divided magnetic material (identified by a tradename "MAGNETITE RB-BL" manufactured by Chitan Kogyo Kabushiki Kaisha of Japan, having average particle size of approximately 0.6$\mu$ and volume resistivity of $3\times10^5\ \Omega$·cm) and 8 parts of carbon black (a coloring agent manufactured by Mitsubishi Chemical Industries, Ltd., of Japan) were mixed together and then kneaded by the use of a heating roll. The kneaded mixture was subsequently allowed to cool and pulverized into fine particles by the use of a known mechanical pulverization method. The resultant particles were mixed with 100 parts of the same finely divided magnetic material (MAGNETITE RB-BL) as above and heat-treated at 130° C. to allow particles of the finely divided magnetic material to be melt-deposited on the pulverized particles, thereby providing the magnetic toner of about 30μ in average particle size. The volume resistivity, as measured in a manner which will be described later, of the magnetic toner so obtained was $8\times10^{8}\Omega\cdot$cm.

Non-magnetic Toner 100 parts of styrene-acrylic resin (identified by a tradename "PLIORITE" manufactured by Good Year Chemical Industries, Ltd., of Japan), 8 parts of the same coloring agent (carbon black) as used in the above magnetic toner and 1 part of dye (identified by a tradename "NYGROSINE" manufactured by Orient Chemical Industries, Ltd., of Japan) were mixed together and then pulverized into fine particles of non-magnetic toner having an average particle size of about 15μ.

The above magnetic toner and the above non-magnetic toner were mixed in a proportion of 9:1 to provide the toner mix I.

Toner Mix II 100 parts of the same styrene-acrylic resin as in the magnetic toner of the toner mix I, 180 parts of the same finely divided magnetic material as in the magnetic toner of the toner mix I and 8 parts of the same coloring agent as in the magnetic toner of the toner mix I were mixed together and then kneaded by the use of a heating roll. The kneaded mixture was subsequently allowed to cool and pulverized into fine particles by the use of a known mechanical pulverization method. The resultant particles were mixed with 20 parts of the same finely divided magnetic material as in the magnetic toner of the toner mix I and heat-treated at 130° C. to allow particles of the finely divided magnetic material to be melt-deposited on the pulverized particles, thereby providing the magnetic toner of about 30μ in average particle size and of $1\times10^{10}\Omega\cdot$cm in volume resistivity.

The magnetic toner so obtained was mixed with the non-magnetic toner of the same composition as that of the non-magnetic toner of the toner mix I, in a proportion of 9:1 to provide the toner mix II.

Toner Mix III 100 parts of the same styrene-acrylic resin as in the magnetic toner of the toner mix I and 200 parts of the same finely divided magnetic material as in the magnetic toner of the toner mix I were mixed together and pulverized into fine particles in a manner similar to that in the preparation of the magnetic toner of the toner mix I.

The resultant pulverized particles were mixed with 8 parts of the same coloring agent as in the magnetic toner of the toner mix I and heat-treated at 130° C. to allow particles of the coloring agent to be melt-deposited on the pulverized particles, thereby providing the magnetic toner of about 30μ in average particle size and of $2\times10^{12}\Omega\cdot$cm in volume resistivity.

The magnetic toner so obtained was mixed with the non-magnetic toner of the same composition as that of the non-magnetic toner of the toner mix I, in a proportion of 9:1 to provide the toner mix III.

Toner Mix IV 100 parts of the same styrene-acrylic resin as in the magnetic toner of the toner mix I, 200 parts of the same finely divided magnetic material as in the magnetic toner of the toner mix I and 8 parts of the same coloring agent as in the magnetic toner of the toner mix I were mixed together and pulverized into fine particles in a manner similar to that in the preparation of the magnetic toner of the toner mix I, which fine particles have an average particle size of 30μ and a volume resistivity of $5\times10^{13}\ \Omega\cdot$cm and constitute a magnetic toner.

The magnetic toner so obtained was mixed with the non-magnetic toner of the same composition as that of the non-magnetic toner of the toner mix I, in a proportion of 9:1 to provide the toner mix IV.

Toner Mix V 100 parts of the same styrene-acrylic resin as in the magnetic toner of the toner mix I, 200 parts of a finely divided magnetic material in the form of (Ni.Zn)O.-$Fe_2O_3$ ferrite (manufactured by TDK) having an average particle size of 0.3μ and a volume resistivity of not lower than $10^{10}\ \Omega\cdot$cm and 8 parts of the same coloring agent as in the magnetic toner of the toner mix I were mixed together and pulverized into fine particles in a manner similar to that in the preparation of the magnetic toner of the toner mix I, which fine particles have an average particle size of 30μ and a volume resistivity of not lower than $10^{14}\ \Omega\cdot$cm and constitute a magnetic toner.

The magnetic toner so obtained was mixed with the non-magnetic toner of the same composition as that of the non-magnetic toner of the toner mix I, in a proportion of 9:1 to provide the toner mix V.

It is to be noted that the non-magnetic toner employed in any one of the toner mixes I to V together with the magnetic toner is of an electrically insulating property since the volume resistivity measurement has failed to show any particular value.

Figure 1:
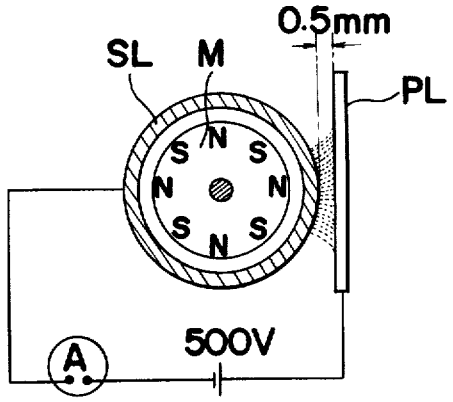
FIG. 1 is a schematic diagram showing the manner of measuring the volume resistivity.

The volume resistivity measurement was carried out by the use of a known magnetic brush developing device of a construction, as schematically shown in FIG. 1, wherein the magnet unit M, corresponding to the magnet unit 11 in FIG. 2, is rotatable within and coaxial to the electroconductive sleeve SL which is fixed in position and which corresponds to the sleeve 10 in FIG. 2, the magnet unit M and the sleeve SL being so selected and so designed as to exert a magnetic force of flux density of about 750 gauss on the outer peripheral surface of the sleeve SL. During the measurement, while the sleeve SL was spaced a minimum distance of 0.5 mm. from a counterelectrode plate PL, an electric potential of 500 volts was applied between the sleeve SL and the counterelectrode plate PL and an electric current flowing through a magnetic brush developed between the sleeve SL and the counterelectrode plate PL was measured to provide a basis for the calculation of the volume resistivity.

EXAMPLE I

By the use of any one of the toner mixes I to V in combination with the electrophotographic copying machine of the construction shown in FIG. 2, the magnetic brush development was carried out while a bias voltage of −300 volt was applied to the sleeve 10. Other operative conditions remained the same as hereinbefore described.

Examination of the reproduced images as to the image contrast, the image resolution and the presence of fog are shown as tabulated in Table 1.

TABLE 1

| No. of Toner Mix | Image Contrast | Image Resolution | Presence of Fog |
|---|---|---|---|
| I | high | low | large |
| II | slightly high | normal | a little |
| III | normal | high | no |
| IV | normal | high | no |
| V | slightly low | normal | no |

From the Table I, it will readily be seen that the use of any one of the toner mixes II to IV has shown the reproduced image to be satisfactory in both of the image resolution and the image contrast. In particular, the reproduced image obtained by the use of any one of the toner mixes III and IV is high in image resolution.

A pattern of distribution of particles of any one of the toner mixes I to V has been examined after the development, but before the transfer of the toner image from the photoconductive support member 1 to the copying paper 8, the result of which is tabulated in Table 2.

TABLE 2

| No. of Toner Mixes | Distribution Pattern of Toner Particles |
|---|---|
| I | Both the magnetic toner particles and the non-magnetic toner particles were attracted to the image area and only the magnetic toner particles were attracted to the non-image area |
| II to IV | In addition to a distribution pattern similar to that resulting from the use of the toner mix I, no toner particle was deposited at a region of 0.1 to 0.5 mm. adjacent the boundary between the image area and the non-image area. |
| V | The magnetic toner particles and the non-magnetic toner particles were deposited on the non-image area and the image area, respectively. |

From Table 2, it will readily be seen that, as a common feature of the toner mixes I to IV, a relatively large amount of the magnetic toner particles were deposited on the perimeter of the image area.

EXAMPLE II

In Example I above, the electrophotographic reproduction was made subject to an original bearing somewhat pale characters. Examination of the reproduced image of the pale characters as to the image contrast has shown that the use of any one of the toner mixes II to V did not result in reduction in line width.

EXAMPLE III

In Example I above, the electrophotographic reproduction was carried out by reducing the number of rotation of the magnet unit 11 within the sleeve 10 from 2,000 r.p.m. to 1,000 r.p.m. Examination of the reproduced image as to the image reproductivity reveals that no reduction in contrast from the front of the image to the rear did occur and reveals a high fidelity reproduction.

For the purpose of comparing the method of the present invention with the method disclosed in the aforesaid copending U.S. application, a series of experiments were conducted by the use of the copying machine of the construction shown in FIG. 2 wherein the bias voltage and the magnetic force of the magnet unit 11 were so adjusted, in a manner as described in the following comparisons, as to avoid the simultaneous deposition of both of the magnetic and non-magnetic toner particles on the non-image area during the magnetic brush development.

Comparison I

A similar experiment as in Example I was conducted by reducing the bias voltage from −300 volt to −200 volt and reducing the flux density of the magnetic force of the magnet unit 11 from 750 gauss to 1,300 gauss. Examination of the reproduced images as to the image contrast, the image resolution and the presence of fog is as tablulated in Table 3 while examination of a pattern of distribution of particles of any one of the toner mixes I to V is tabulated in Table 4.

TABLE 3

| No. of Toner Mix | Image Contrast | Image Resolution | Presence of Fog |
|---|---|---|---|
| I | normal | low | large |
| II | normal | low | large |
| III | low | low | large |
| IV | low | normal | a little |
| V | very low | normal | a little |

TABLE 4

| No. of Toner Mix | Distribution Pattern of Toner Particles |
|---|---|
| I & II | Although the density of deposition of the toner particles on the image area was sufficient, the edge of the image and the line width tend to become slackened and reduced, respectively and the non-magnetic toner particles were somewhat deposited on the non-image area. |
| III to V | Deposition of the toner particles on the image area was such that the edge effect appeared while no problem of slackening occurred and, however, the amount of the toner particles deposited was small with the consequent reduction in density. |

Comparison II

In the Comparison I, the electrophotographic reproduction was made subject to an original bearing somewhat pale characters. Examination of the reproduced image of the pale characters as to the image contrast has shown that the use of any one of the toner mixes I and II resulted in reduction of the line width with low contrast.

Comparison III

In the Comparison I, the electrophotographic reproduction was carried out by reducing the number of rotation of the magnet unit 11 within the sleeve 10 from 2,000 r.p.m. to 1,000 r.p.m. Examination of the reproduced image as to the image reproductivity reveals that considerable reduction in contrast from the front of the image to the rear did occur and reveals an inferior reproduction.

From the foregoing, it is clear that the method of the present invention wherein, during the development process, the magnetic toner particles purposefully electrically charged to the same polarity as that of the electrostatic latent image are allowed to deposit on the non-image area of the electrostatic latent image is superior in image resolution and contrast to the conventional method wherein the development is carried out to avoid any fog occurring in the non-image area. This can readily be understood by the comparison of Table 1 with Table 2.

However, as far as the method of the present invention is concerned, the use of the toner mix I of $10^8$ Ω·cm in volume resistivity did not give favorable results. In other words, not only did the toner mix I result in an insufficient image resolution, but also the use of the toner mix I brought about a disadvantage such that during the transfer of the toner image from the photoconductive support member to the copying paper by means of the corona discharge technique, the magnetic toner particles were transferred on to the non-image area, thereby constituting a foggy reproduction.

On the other hand, the use of the toner mix V of not less than $10^{-}$Ω·cm in volume resistivity gave a low image contrast though considerably improved, since no magnetic toner particles were deposited on the image area during the development process.

Discussion will hereinafter be made about the reason that the electrophotographic copying method wherein particles of the magnetic toner are allowed to deposit on the non-image area during the magnetic brush development process brings about an improvement in image resolution and image contrast and the reason that, in the practice of such method, the magnetic toner having a relatively low volume resistivity such as the toner mix I or a relatively high volume resistivity such as the toner mix V is not favorable.

Figure 3A:
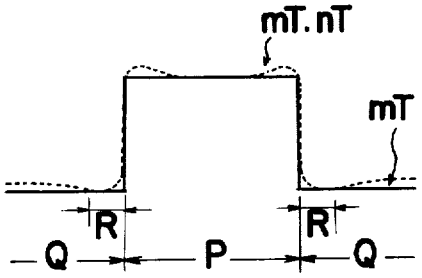
FIGS. 3(*a*) and 3(*b*) show respective manners of deposition of different developing materials relative to an electric potential on a photoconductive support member.
Figure 3B:
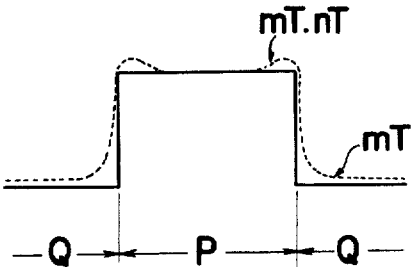

FIGS. 3(*a*) and 3(*b*) schematically illustrate the respective manners of deposition of particles of any one of the toner mixes II to IV and those of the toner mix I relative to identical electric potentials of the electrostatic latent images, which are depicted by reference to Table 2 for the purpose of the discussion. In each of these figures the solid line represents the electric potential of the electrostatic latent image, characters "P" and "Q" represent image and non-image area, respectively, and the dotted line represents the manner of deposition of toner particles.

In the case where any one of the toner mixes II to IV is used during the development process, as shown in FIG. 3(*a*), toner particles are not deposited on the boundary region R of the non-image area Q adjacent the image area P while particles of only the magnetic toner are deposited on the other region of the non-image area Q rather than the boundary region R. At the edge portion of the image area, the toner particles are deposited in an increased amount.

On the other hand, in the case where the toner mix I is used during the development process, the toner particles are deposited not only on the image area P, but also on the boundary region of the non-image area Q, constituting a continuous pattern of deposition in varying amount as shown in FIG. 3(*b*).

When it comes to the transfer of the toner image from the photoconductive support member to the copying paper, the deposit of the particles of any one of the toner mixes II to IV on the non-image area Q is not substantially transferred, whereas the deposit of particles of the toner mix I on the non-image area Q including those on the boundary region is transferred.

From this, it will readily be seen that the use of any one of the toner mixes II to IV, the particles of which deposit in the manner as hereinabove discussed, brings about an improvement in image resolution.

Though the theory of the above described phenomenon has not yet been resolved, it appears that the high resistance characteristic, i.e., chargeability, of the magnetic toner particles used and the amount of the bias voltage applied greatly affect the image resolution. In other words, in Example I, the bias voltage of −300 volt was applied to the sleeve while the electrostatic latent image was such that the maximum potential of the image area and the potential of the non-image area were −550 volts and −150 volts, respectively. This means that the maximum potential of the image area and the potential of the non-image area relative to the applied bias voltage were −250 volt and +150 volts, respectively.

Such being the case, the use of any one of the toner mixes II to IV and the use of the toner mix I resulted in a difference such as shown in Tables 1 and 2 and as shown in FIGS. 3(*a*) and 3(*b*).

As far as the magnetic toner used in any one of the toner mixes II to IV is involved, though it is of a relatively high volume resistivity and capable of being electrically charged by friction, the volume resistivity thereof is such a value that electric potential can be injected. When this magnetic toner is mixed with the non-magnetic toner on the sleeve, the both are electrostatically charged as a result of frictional electricity with the non-magnetic toner and the magnetic toner polarized respectively to the polarity opposite to and the same as that of the electrostatic latent image. In this Example, the non-magnetic toner and the magnetic toner were electrically charged with positive and negative potentials, respectively. When the magnetic brush composed of particles of the non-magnetic and magnetic toners so electrically charged slidingly contacts the photoconductive support member, it appears that the non-magnetic toner particles are forced to deposit on the image area by the action of the Coulombic force and the magnetic toner particles are deposited on the image and non-image areas in different manners. In other words, at the image area, the potential is injected into the particles of the magnetic toner to be deposited on a high potential region and the polarity of each particle of the magnetic toner is reversed to a positive polarity with these magnetic toner particles consequently deposited. On the other hand, since the non-image area is relatively of a positive polarity as hereinbefore described, particles of the magnetic toner which have been charged to a negative polarity by the friction with the non-magnetic toner particles are deposited on the non-image area. However, at the region adjacent the boundary between the image area and the non-image area, the magnetic toner particles which have been charged to a negative polarity as a result of friction electricity are repelled by the negative potential of the image area. Accordingly, no substantial toner deposition occurs in this region, but the deposit of the toner particles on the image area steeply sets up under the influence of the electric repellent force.

However, in the case of the toner mix I, since the magnetic toner constituting the toner mix I has a low volume resistivity, the electric charge is injected into the magnetic toner particles and the magnetic toner particles are therefore deposited not only on the image area, but also on the non-image area and the boundary region of the non-image area adjacent the image area, resulting in the edge portion of the image developed with particles of the toner mix I being deposited with a gently increasing amount of the toner particles as shown in FIG. 3(*b*).

In the case of the toner mix V, since the magnetic toner constituting the toner mix V has a very high volume resistivity, the charge injection no longer take place and the magnetic toner particles are deposited only on the non-image area by the effect of the potential charged as a result of frictional electricity.

When the toner image so developed is to be transferred from the photoconductive support member to the copying paper, since the magnetic toner of any one of the toner mixes II to V is of a relativley high volume resistivity, the magnetic toner particles deposited on the non-image area retain their negative polarity the same as that of the transfer corona charger and, therefore, are not transferred from the photoconductive support member to the copying paper while only the magnetic toner particles steeply set up in the image area are allowed to be transferrred from the photoconductive support member to the copying paper, thereby giving a reproduced image of high resolution. On the contrary thereto, however, in the case of the toner mix I, since the magnetic toner particles deposited on the non-image area are also transferred from the photoconductive support member to the copying paper together with the toner particles deposited on the image area, the reproduced image tends to become foggy.

In any event, if the development is performed by the use of the developing material consisting of the magnetic toner of a high volume resistivity within the range of $10^{10}$ to $10^{13}$ Ω·cm and the non-magnetic and electrically insulating toner, and in such a manner as to produce a slight fog on the non-image area, the subsequent corona transfer of the developed toner image from the photoconductive support member to the copying paper can result in reproduction of the image of high resolution.

Although in any one of the foregoing Examples, the bias voltage has been described as adjusted to result in the development of the toner image wherein the non-image area is caused to be foggy, a similar objective can also be accomplished by adjusting the magnetic force of the magnet unit within the sleeve and/or the minimum possible distance between the sleeve and the photoconductive support member. However, since the magnetic toner is charged to a polarity the same as that of the electrostatic latent image by the friction with the non-magnetic toner during the development process as hereinbefore described, the bias voltage required for the magnetic toner to be deposited on the non-image area must be higher than, and have a polarity the same as, the potential of the non-image area of the electrostatic latent image so that the potential of at least the non-image area can be reversed in polarity opposite to that of the electrostatic latent image. By way of example, if in Example I a bias voltage of −200 volt is applied while the maximum potential of the image area and the potential of the non-image area are −550 volt and −150 volt, respectively, the maximum potential of the image area and the potential of the non-image area, both relative to the applied bias voltage, are −350 volt and +50 volts, thereby satisfying the above described requirement. In this case, the magnetic flux density of the magnet unit may be reduced from 1,300 gauss to a value sufficient for the toner particles to be deposited.

Furthermore, in any one of the foregoing Examples, the developing material, that is, the toner mix, consisting of 90 wt% of the magnetic toner and 10 wt% of the non-magnetic toner has been described as used. However, in the present invention, the developing material consisting of the magnetic toner in an amount within the range of 85 to 98 wt% and the non-magnetic toner in an amount within the range of 2 to 15 wt%, the percentage being based on the total weight of the developing material, may also be employed. In particular, the developing material consisting of the magnetic toner in an amount within the range of 90 to 95 wt% and the non-magnetic toner in an amount within the range of 5 to 10 wt% is preferred. It is, however, to be noted that, if the amount of the non-magnetic toner is not more than 2 wt%, the use of the developing material tends to result in reproduction of an image of low contrast and, if the amount of the non-magnetic toner is not less than 15 wt%, the use of the developing material tends to result in the increased fog on the non-image area during the development and, therefore, will not result in a high fidelity image reproduction.

In view of the foregoing, in the practice of the method of the present invention, the development of the toner image on the photoconductive support member by depositing positively on the non-image area of the electrostatic latent image the magnetic toner particles triboelectrically charged to a polarity the same as that of the electrostatic latent image and the use of the developing material consisting of the magnetic toner of a volume resistivity within the range of $10^{10}$ to $10^{13}$ Ω·cm., preferably, $10^{12}$ to $10^{13}$ Ω·cm and the non-magnetic and electrically insulating toner are essential. So far as the volume resistivity is within the above described range, the toner particles can not only be electrically charged by friction, but also injected with the electric charge and, therefore, it is possible to achieve the development wherein the magnetic toner particles deposit on both of the image area and the non-image area, but not on the boundary region of the non-image area adjacent the image area, as hereinbefore fully described.

Since the electrophotographic copying method of the present invention is such that the magnetic toner is consumed by deposition on the non-image area of the electrostatic latent image on the photoconductive support member 1, the copying machine shown in FIG. 2 is so designed that the excess magnetic toner particles removed from the photoconductive support member 1 by the blade 20 can be recovered back to the developer unit 4 by means of the recovery conduit 22. In order to examine the durability of the developing material utilizable in the practice of the method of the present invention, a series of experiments have been conducted wherein the copying machine was repeatedly operated, with a mass of the toner mix III supplied into the hopper 12, to reproduce the image on fifty thousand copying papers and, as a result thereof, it has been found that the image reproduced on the first copying paper and that on the last copying paper did not vary in quality and that the mixing ratio of the magnetic and non-magnetic toners had not deviated. A microscopic observation using an electron microscope has shown no variation in surface condition of the cyclically used particles of the developing material.

It is to be noted that, where no recovery conduit 22 is employed in the copying machine, a relatively large amount of the developing material is consumed, which varies depending upon the amount of the developing material required for an original to be reproduced on one copying sheet. By way of example, assuming that the original is such as to require the consumption of 50 mg. of the developing material in order for the image of such original to be reproduced on one copying paper, the toner particles in an amount of 20 mg. out of the required 50 mg. are deposited on the non-image area. Therefore, if the copying machine is equipped with the recovery system such as represented by the recovery conduit 22 in FIG. 2, the toner particles in an amount equal to the balance, i.e., (50 mg. − 20 mg.), are actually consumed in reproducing the image of the original on the copying paper. Therefore, the method of the present invention is effective and advantageous in reducing the amount of the developing material required.

Although the present invention has fully been described in connection with the preferred examples, it is to be noted that these examples are not intended to limit the scope of the present invention, but are intended only for the purpose of illustration of the present invention. In addition, various changes and modifications are apparent to those skilled in the art and, therefore, such changes and modifications are to be understood as included within the true scope of the present invention unless they depart therefrom.

We claim:

1. An electrophotographic copying method which comprises the steps of:

a. forming an electrostatic latent image on a photoconductive support member, said electrostatic latent image being comprised of an image area and a non-image area;

b. developing the electrostatic latent image to a toner image with a developing material consisting of a particulate, magnetic toner having a volume resistivity of about $10^{10}$ to $10^{13}$ Ω·cm and a particulate, non-magnetic, electrically insulating toner;

said magnetic toner being present in an amount of 85 to 98% and said non-magnetic toner being present in an amount of 2 to 15%, said percentages being based on the total weight of the development material;

said development, being effected by the magnetic brush method and comprising:

(i) triboelectrically charging said magnetic and non-magnetic toners, the polarity of said non-magnetic toner being opposite that of said electrostatic latent image and the polarity of said magnetic toner being the same as that of said electrostatic latent image, (ii) magnetically attracting said developing material to the surface of a sleeve having a magnet housed therein to form a magnetic brush thereon and (iii) contacting said electrostatic latent image with said magnetic brush whereby particles of both magnetic and non-magnetic toner are deposited on and adhere to said image area and particles of said magnetic toner are deposited on and adhere to said non-image area;

and during said development applying a bias voltage of the same polarity but of a higher value than the potential of the non-image area of said latent image, to avoid deposition of particles of non-magnetic particles on said non-image area and to permit the magnetic toner to overcome the magnetic force exerted thereon by said magnet in said sleeve;

b. transferring the particles of both of the magnetic and non-magnetic toners, which have been deposited on the image area of the electrostatic latent image, from the photoconductive support member to a sheet of final support material by means of a corona charge technique; and c. fixing the toner image so transferred to the sheet of final support material.

2. A method as claimed in claim 1, wherein the deposit of the particles of the magnetic toner on the non-image area of the electrostatic latent image during the developing step is carried out by increasing the bias voltage.

3. A method as claimed in claim 1, wherein the magnetic toner employed in the developing material has a volume resistivity within the range of $10^{12}$ to $10^{13}$ Ω·cm.

4. A method as claimed in claim 2, wherein the magnetic toner employed in the developing material has a volume resistivity within the range of $10^{12}$ to $10^{13}$ Ω·cm.

5. A method as claimed in claim 1, further comprising a step of recovering the particles of the magnetic toner, deposited on the non-image area, subsequent to the transferring step.

* * * * *